US005971390A

United States Patent [19]

Caspar et al.

[11] Patent Number: 5,971,390

[45] Date of Patent: Oct. 26, 1999

[54] SHEET ALIGNING APPARATUS

[75] Inventors: Christopher Keith Caspar, Shelbyville; Edmund Hulin James, III, Lexington; Kurt Matthew Korfhage, Shelbyville; Christopher Patrick Murphy; Jerry Wesley Raider, both of Lexington, all of Ky.

[73] Assignee: Lexmark International, Inc., Lexington, Ky.

[21] Appl. No.: 09/022,219

[22] Filed: Feb. 11, 1998

[51] Int. Cl.[6] ..... B65H 3/52

[52] U.S. Cl. ..... 271/121; 271/124; 271/171; 271/167; 271/236; 271/250

[58] Field of Search ..... 271/34, 42, 124, 271/121, 145, 171, 167, 149, 236, 240, 242, 250; 400/629, 630, 633

[56] References Cited

U.S. PATENT DOCUMENTS

| | | | |
|---|---|---|---|
| 5,480,247 | 1/1996 | Saikawa et al. | 400/629 |
| 5,527,026 | 6/1996 | Padget et al. | 271/21 |
| 5,527,029 | 6/1996 | Bortolotti et al. | 271/121 |
| 5,775,688 | 7/1998 | Kato et al. | 271/167 |

FOREIGN PATENT DOCUMENTS

| | | | |
|---|---|---|---|
| 403264437 | 11/1991 | Japan | 271/121 |

OTHER PUBLICATIONS

Lamos, Aligning Sheet Feeder, IBM Technical Disclosure Bulletin vol. 20 No. 4, p. 1295.

*Primary Examiner*—H. Grant Skaggs
*Attorney, Agent, or Firm*—John A. Brady

[57] ABSTRACT

Each sheet of a stack of media is aligned with a fixed alignment surface prior to being fed towards a process station of a printer by a single pick roll. During the first portion of its cycle of operation, the sheet advancing force of the pick roll, which is offset from the axis or centerline of the sheet, exerts a torque on at least the uppermost sheet of the stack to have one of its sides engage the alignment surface if it is skewed. When the one side of the sheet is not engaging the alignment surface when the pick roll is initially energized, the uppermost sheet's leading edge engages a resilient projection of an insert of a rib, which is offset from the axis of the sheet but farther from the alignment surface than the pick roll. The skewed sheet pivots about the projection, which is formed of a high coefficient of friction material, extending beyond the surface of the rib. During the remainder of its energization, the pick roll advances the sheet towards the process station of the printer.

13 Claims, 7 Drawing Sheets

SHEET ALIGNING APPARATUS

FIELD OF THE INVENTION

This invention relates to an apparatus for aligning at least the uppermost sheet of a stack of sheets of a media as the uppermost sheet is advanced towards a process station and, more particularly, to an aligning apparatus in which one side of at least the uppermost sheet is aligned when the leading edge of the uppermost sheet engages an element of a sheet separator inclined relative to the sheet support to separate the uppermost sheet from the stack.

BACKGROUND OF THE INVENTION

In a printer, it is desired for each sheet of media to be aligned as accurately as possible when it enters a print mechanism (process station) of the printer. In inkjet printers, this alignment has primarily been accomplished by employing two pick rolls feeding each sheet of media from a stack of sheets into a feed roll nip and then backing the fed sheet up to align it with the feed mechanism feeding the sheet through the feed roll nip to the print mechanism.

Another alignment arrangement in an inkjet printer has fed each sheet of media from the two pick rolls into counter-rotating rolls, which are reversed after the sheet is ready to be fed to the print mechanism. The counter-rotating rolls enable the sheet to straighten its leading edge to some extent before the directions of the counter-rotating rolls are reversed.

Each of these arrangements has used the two pick rolls to maintain each sheet of media as straight as possible as the condition in which it was loaded. These arrangements have utilized two edge guides for engaging the two sides of each sheet of the media with at least one of the two edge guides being adjustable. This has required the user to load a stack of sheets against one of the edge guides, usually permanently fixed, and have the other, adjustable edge guide bearing against the opposite side of the stack of sheets.

If the adjustable edge guide is not firmly engaged with the side of the stack of sheets by the user and the sides of the sheets of the stack are not in contact along their entire length with the fixed edge guide, then the sheet will be skewed when advanced by the two pick rolls from the stack. As a result, the sheet may enter the print mechanism in a skewed condition, notwithstanding the previously suggested skew correction arrangements, because of the adjustable guide not being firmly retained against the side of each sheet, for example.

SUMMARY OF THE INVENTION

The sheet aligning apparatus of the present invention requires only a single pick roll and eliminates the need for a user to be precise in loading sheets of a media as a stack on a support for feeding by the single pick roll. The sheet aligning apparatus accomplishes this by disposing the single pick roll and a single edge buckling device, which is used for separation of the uppermost sheet from the stack of sheets during its advancement from the stack, preferably to one side of the axis or centerline of the sheets of media. The single edge buckling device is positioned further from an alignment edge than the single pick roll and preferably on the same side of the axis or centerline of the sheet as the single pick roll.

This arrangement enables the sheet advancing force of the single pick roll to produce a torque on the advancing sheet so that its side is moved into engagement with the fixed alignment surface or edge. This torque is applied during the initial portion of each cycle of rotation of the pick roll. Thus, each sheet has one side aligned with the alignment surface or edge during picking of the uppermost sheet from the stack by the pick roll and its advancement of the uppermost sheet from the stack.

With the pick roll on one side of the axis of the sheet being advanced, the sheet is more constrained on this side than on its non-driven side. As a result, the non-driven side has a shorter path to the nip of the feed rolls and arrives at the nip first even though the sheet is being fed relatively straight.

The sheet is not fed into the feed roll mechanism until the driven side arrives at the feed roll position aligning in a substantially parallel position the leading edge of the sheet of media to the nip of the feed roll, for example. This is because the counter rotating feed rolls are not reversed until advancement of the sheet by the pick roll has stopped so that the counter rotating feed rolls function as a stop. Likewise, since the feed rolls rotate only when the sheet is to be fed by the feed rolls, the nip functions as a stop.

An object of this invention is to provide a sheet aligning apparatus for removing skew from each fed sheet of media.

Another object of this invention is to provide a sheet aligning apparatus in which a greater amount of skew may occur when the stack of sheets of media is loaded by a user on a support without causing the sheet to be skewed when it enters the feed mechanism of a printer.

A further object of this invention is to control the alignment of a sheet between the pick mechanism and the feed mechanism of a printer.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
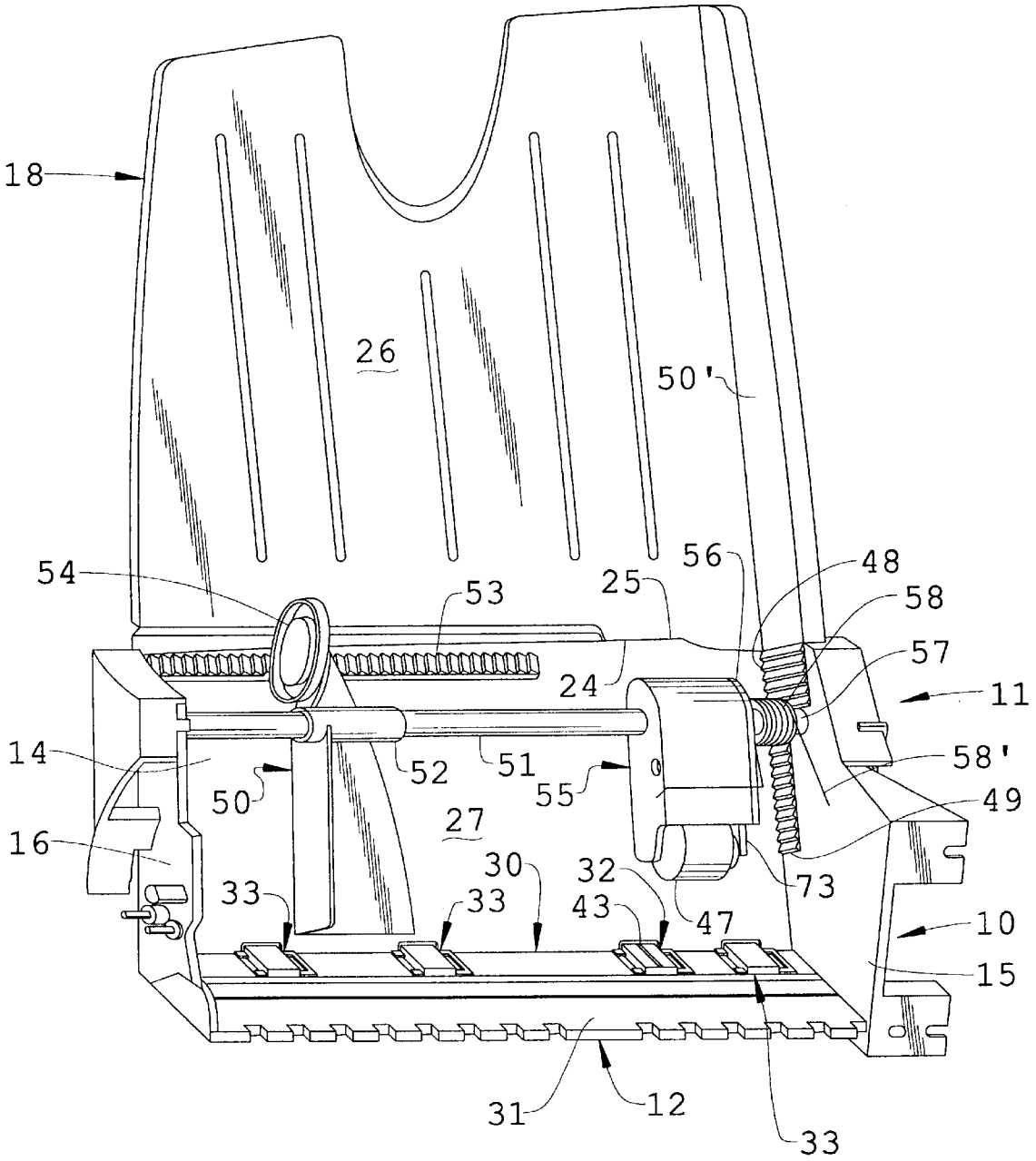
FIG. 1 is a front perspective view of a sheet aligning apparatus of the present invention for supporting a stack of sheets of a media thereon.
Figure 5:
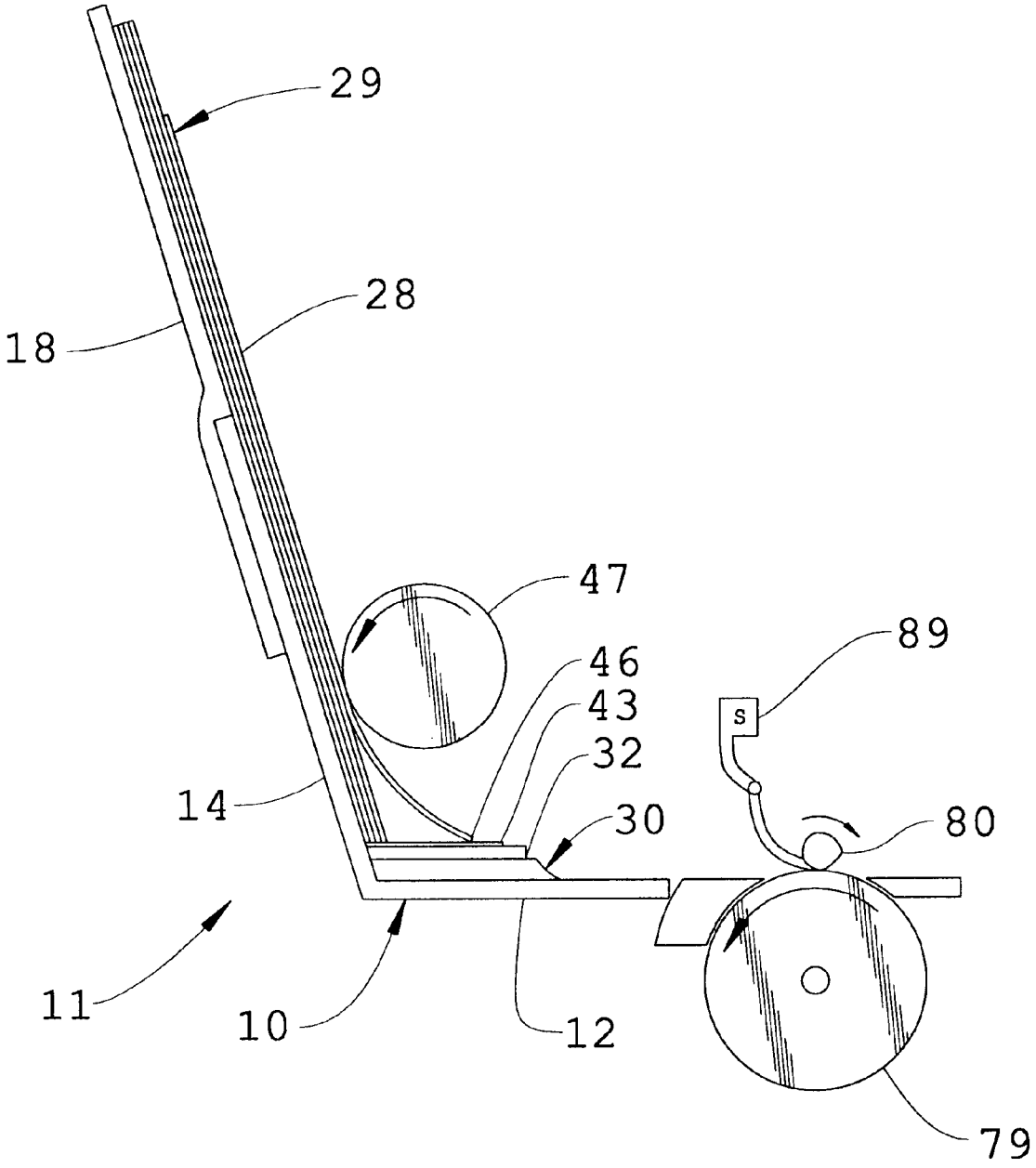
FIG. 5 is a schematic side elevational view of the feed path of an uppermost sheet being advanced from a stack of sheets supported by the sheet aligning apparatus of FIG. 1 by a pick roll to feed rolls of a printer and the sheets shown thickened for clarity purposes.

Referring to the drawings and particularly FIG. 1, there is shown an automatic sheet feeder frame 10 of a printer 1. The frame 10, which is preferably formed of plastic, includes a substantially horizontal bottom wall 12 and an inclined wall 14 extending upwardly from the back of the bottom wall 12. The inclined wall 14 is inclined at an obtuse angle of preferably about 115° to the bottom wall 12 as shown in FIG. 5. The frame 10 (see FIG. 1) is fixed to a fixed carrier frame (not shown) of the printer 11.

The frame 10 has substantially parallel side walls 15 and 16 extending upwardly from the sides of the bottom wall 12. The side walls 15 and 16 are integral with the sides of the bottom wall 12 and the sides of the inclined wall 14.

Figure 2:
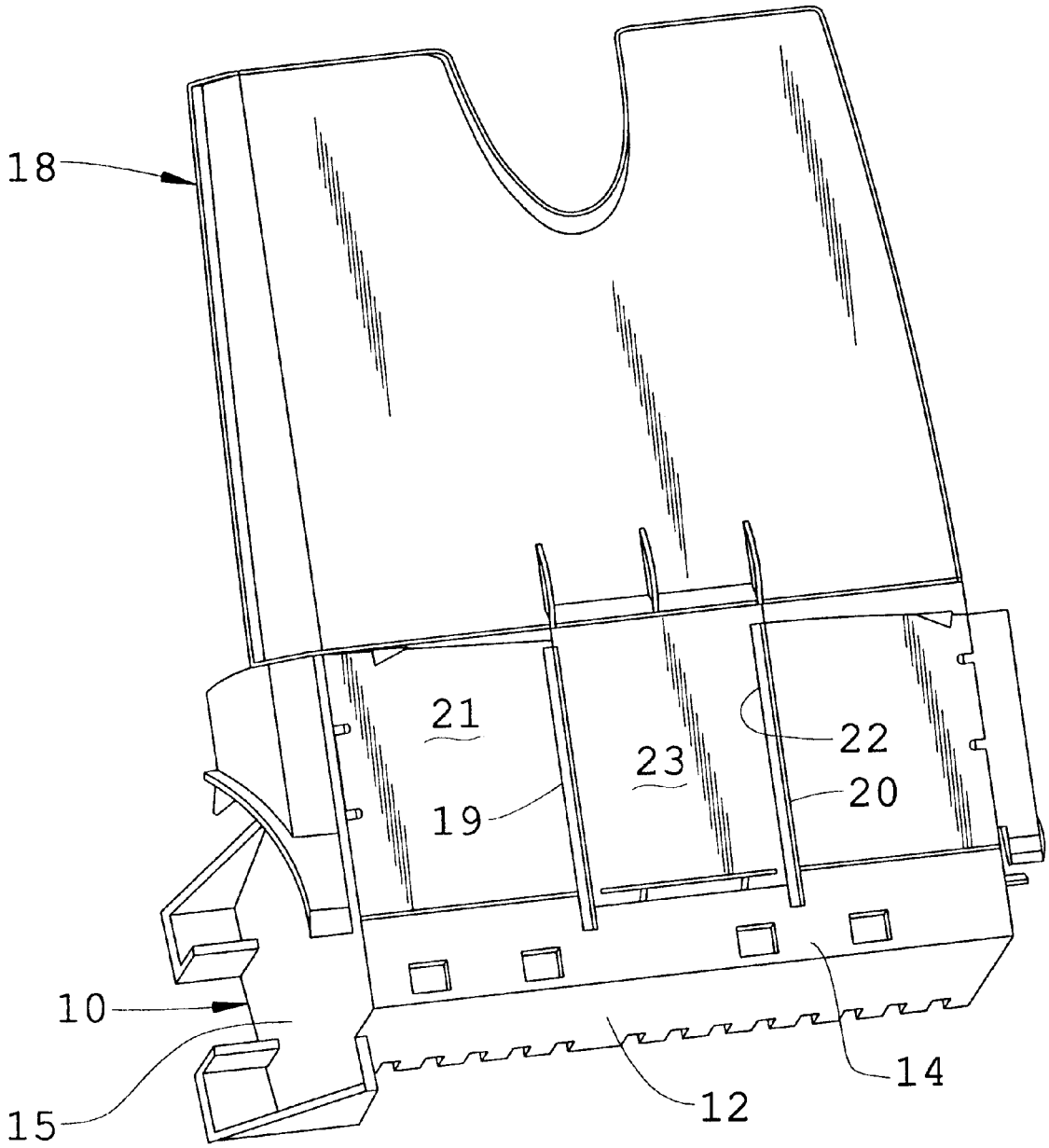
FIG. 2 is a rear perspective view of the sheet aligning apparatus of FIG. 1.

A tray 18, which is preferably formed of plastic, is releasably supported on the inclined wall 14. As shown in FIG. 2, the inclined wall 14 has a pair of guide rails 19 and 20 mounted on its rear surface 21 to form a slot 22 therebetween.

A tongue 23 of the tray 18 extends into the slot 22 to releasably attach the tray 18 to the frame 10 for support by the frame 10. As shown in FIG. 1, a bottom edge 24 of the tray 18 abuts upper edge 25 of the inclined wall 14 so that a front surface 26 of the tray 18 and a front surface 27 of the inclined wall 14 form a continuous support surface.

The front surface 27 of the inclined wall 14 and the front surface 26 of the tray 18 cooperate to support a plurality of sheets 28 (see FIG. 5) of a media such as bond paper, for example, in a stack 29. The sheets 28 may be any other suitable media such as labels or envelopes or cardstock, for example.

The substantially horizontal bottom wall 12 (see FIG. 1) of the frame 10 has a rib support plate 30, which is preferably formed of plastic, mounted on its upper surface 31. The rib support plate 30 is inclined away from the continuous support surface for the sheets 28 (see FIG. 5).

The rib support plate 30 (see FIG. 1) has a rib 32 extending therefrom and three substantially parallel ribs 33, which also are substantially parallel to the rib 32, also extending therefrom. Thus, the rib support plate 30 is a base surface from which the ribs 32 and 33 extend. The rib 32 is disposed between two of the three ribs 33.

The rib 32 includes a body 34 (see FIG. 3) of metal such as stainless steel, for example, having a coating 35 (Shown enlarged in FIG. 3 for clarity purposes.) of a low coefficient of friction material such as TEFLON fluoropolymer, for example, forming its exterior surface.

The body 34 includes a main top wall 36 having a pair of substantially parallel side walls 37 extending substantially perpendicular thereto. Thus, the body 34 is substantially U-shaped.

Each of the side walls 37 of the body 34 has a portion 38 extending therefrom for an interference fit within a recess or hole (not shown) in a block 39, which is mounted within a recess 40 in the rib support plate 30. Each of the side walls 37 has its free end resting on a surface of 40' of the recess 40.

The main wall 36 of the body 34 has a longitudinal slot 41 therein. The slot 41 terminates prior to the longitudinal ends of the main wall 36 of the body 34.

An insert 42 is disposed within the body 34. The insert 42 is formed of a suitable material having a high coefficient of friction with paper such as polyurethane, for example. One suitable example of the polyurethane is sold by Dow Chemical as Pellethane 2103 70 Shore A. The insert 42 has a projection 43 extending along its entire length.

The insert 42 has its substantially parallel side walls 44 resting on a surface 44' of the rib support plate 30. Thus, the insert 42 (see FIG. 3) is retained by being trapped between the body 34 of the ribs 32 and the surface 44' of the rib support plate 30.

The projection 43 extends beyond the coating 35 on the body 34 for a predetermined distance. For example, when the projection 43 has a width of 1.5 mm, the projection 43 extends 0.25 mm beyond the coating 35 on the body 34. The same proportions would exist for a greater or lesser distance that the projection 43 of the insert 42 extends beyond the coating 35 on the body 34. The distance between the outer surfaces of the side walls 44' of the insert 42 is 12.4 mm.

In addition to the configuration of the insert 42 controlling the distance that the projection 43 extends beyond the coating 35 of the body 34, a preload is created by the configuration and the material of the insert 42. Thus, the resilience of the polymeric insert 42 and the preload combine to determine when the projection 43 is moved inwardly so as to not project beyond the coating 35 of the body 34 when the sheet 28 is a stiff media.

The projection 43 is proximate or adjacent the coating 35 because there is only a very slight space therebetween. When the sheet 28 is stiff and has a thickness of 0.1 mm and the projection 43 has a width of 1.5 mm and the slot 41 in the body 34 has a width of 2.5 mm, the total preload on the insert 42 should be such that the sheet 28 pushes the sheet engaging surface of the projection 43 flush with the coating 35.

The coefficient of friction of the insert 42 with respect to the edge of a sheet of paper is preferably greater than 0.7 and must be greater than 0.3. The coating 35 preferably provides a coefficient of friction with respect to a sheet of paper of less than 0.15 and must be less than 0.2.

When the sheet 28 is stiff, the projection 43 of the insert 42 is moved into the body 34 by advancement of the sheet 28 in the direction of an arrow 45. In this way, the total area of the projection 43 engaging a leading edge 46 of the sheet 28 is very small in comparison with the total area of the coating 35 engaging the edge of the sheet 28. Thus, there is effectively no resistance change in the advancement of the sheet 28 when it is a stiff media than when there is only the coating 35.

Figure 3:
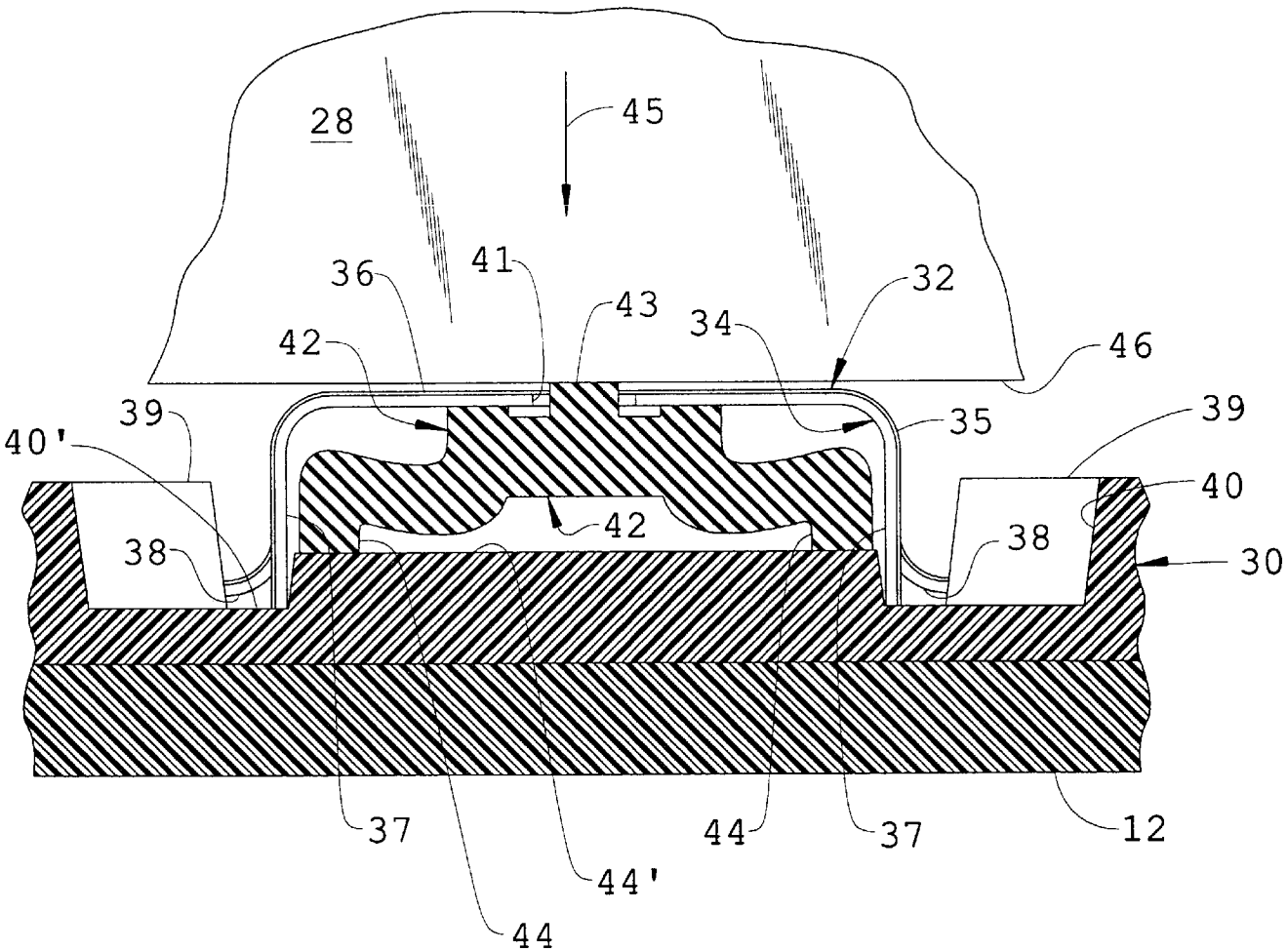
FIG. 3 is a cross sectional view of a rib having a high coefficient of friction surface used as part of a sheet separator in the sheet aligning apparatus of FIG. 1.

However, when the sheet 28 has a low stiffness so as to be flexible, the projection 43 remains in its extended position of FIG. 3 as the sheet 28 is advanced in the direction of the arrow 45. Thus, as shown in FIG. 3, the high coefficient of friction projection 43 has a larger area engaging the edge of the sheet 28 in comparison with the coating 35.

As a result, the resistance force to movement of the sheet 28 by a pick roll 47 (see FIG. 1) increases. Accordingly, the sheet 28 corrugates or buckles upwardly and inwardly towards the rib 32.

Each of the ribs 33 has only the body 34 (see FIG. 3) with the coating 35. The body 34 of each of the ribs 33 (see FIG. 1) does not have the longitudinal slot 41 (see FIG. 3).

When the sheets 28 are disposed on the front surface 26 (see FIG. 1) of the tray 18 and the front surface 27 of the inclined wall 14 of the frame 10, the leading edge 46 (see FIG. 5) of each of the sheets 28, which form the stack 29, engages the projection 43 (see FIG. 3) of the insert 42. Because the projection 43 is extending beyond the coating 35, none of the ribs 33 (see FIG. 1) will be engaged by the leading edge 46 (see FIG. 3) of each of the sheets 28 forming the stack 29 (see FIG. 5) but only the projection 43 (see FIG. 3) will engage the leading edge 46 of each of the sheets 28 forming the stack 29 (see FIG. 5) when there is no skew.

The right side wall 15 (see FIG. 1) has an alignment surface or edge 48 formed thereon by a plurality of projections 49, which are integral with the right side wall 15 but extend therefrom. Thus, the projections 49 constitute the alignment surface or edge 48 against which a side of each of the sheets 28 (see FIG. 3) is to be held against by an adjustable edge 50 (see FIG. 1). It should be understood that an inner surface of a right side wall 50' of the tray 18 aligns with the alignment surface or edge 48 when the tray 18 is mounted in the position of FIG. 1.

The adjustable edge 50 is slidably mounted on a rotatable shaft 51, which is rotatably supported by the side walls 15 and 16, through having a cylindrical portion 52 supported on the rotatable shaft 51. The adjustable edge 50 has a downwardly extending tooth (not shown) for engaging one of a plurality of teeth 53 formed in the front surface 27 of the inclined wall 14 of the frame 10.

Each of the teeth 53 is formed so that the tooth on the adjustable edge 50 may pass over each of the teeth 53 as the adjustable edge 50 is moved towards the right side wall 15. Each of the teeth 53 prevents motion of the adjustable edge 50 away from the right side wall 15 unless a release button 54 on the adjustable edge 50 is pushed towards the right side wall 15 to remove the tooth thereon from engagement with any of the teeth 53 on the front surface 27 of the inclined wall 14 of the frame 10. Thus, the adjustable edge 50 is releasably fixed to hold one side of each of the sheets 28 (see FIG. 5) against the aligning surface or edge 48 (see FIG. 1).

Each of the sheets 28 (see FIG. 5) is advanced from the stack 29 by the single pick roll 47 of an auto-compensating mechanism, versions of which are particularly shown and described in U.S. Pat. No. 5,527,026 to Padgett et al. The pick roll 47 is rotatably supported by a arm 55, which is pivotally mounted on the rotatable shaft 51.

A collar 56 is rotatably mounted on the rotatable shaft 51 between the side wall 15 and the pick roll arm 55 through having a cylindrical spacer 57 integral therewith. The collar 56 has a diameter to limit the height of the sheets 28 (see FIG. 5) of the stack 29 so that the pick roll arm 55 is prevented from being engaged by the sheets 28.

The rotatable shaft 51 (see FIG. 1) has a flat formed thereon to have its shoulder function as a stop for stopping sliding movement of the pick roll arm 55 towards the left side wall 16 of the frame 10. The collar 56 limits sliding movement of the pick roll arm 55 towards the right side wall 15 of the frame 10.

A spring 58 has one end supported in a slot 58' in the right side wall 15 of the frame 10 and its other end continuously urging the pick roller 47 into engagement with the uppermost sheet 28 of the stack 29 (see FIG. 5). The spring 58 (see FIG. 1) applies a preload force against the uppermost sheet 28 (see FIG. 5) of the stack 29.

This preload force insures that the pick roller 47 (see FIG. 4) always engages the uppermost sheet 28 of the stack 29 (see FIG. 5) irrespective of the position of the inclined wall 14 (see FIG. 1). The preload force of the spring 58 also insures that the pick roll 47 will feed the uppermost sheet 28 (see FIG. 5) when it is formed of a low coefficient of material such as a slick sheet of stiff media, for example.

The rotatable shaft 51 (see FIG. 1) is driven from a gear 59 (see FIG. 6) on a shaft 60 of a reversible motor 60' meshing with a gear 61 of a compound gear 62 having a gear 63 engage a gear 64 of a compound gear 65. A gear 66 of the compound gear 65 engages a clutch gear 67. The clutch gear 67 is supported on a plate 67A pivotally mounted on a post 67B supporting the compound gear 65 and providing the axis of rotation of the compound gear 65.

The clutch gear 67 is rotatably mounted on a pin 67C extending from the plate 67A. A spring washer (not shown) is mounted on the pin 67C and has the clutch gear 67 mounted thereon to create a drag.

Figure 6:
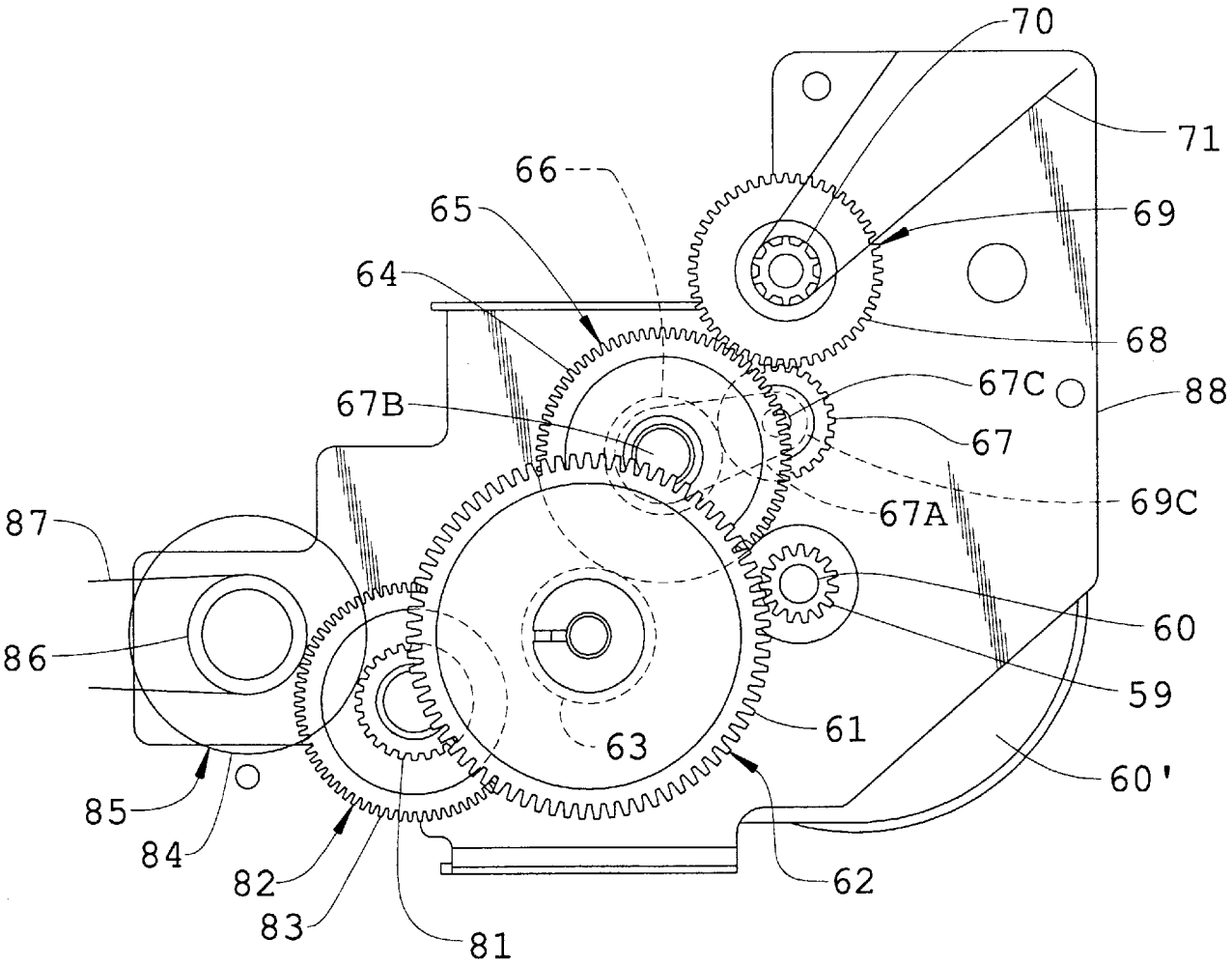
FIG. 6 is an elevation view of a drive system for the pick roll and the feed rolls of the sheet aligning apparatus of FIG. 1 in which the pick roll is being driven.
Figure 7:
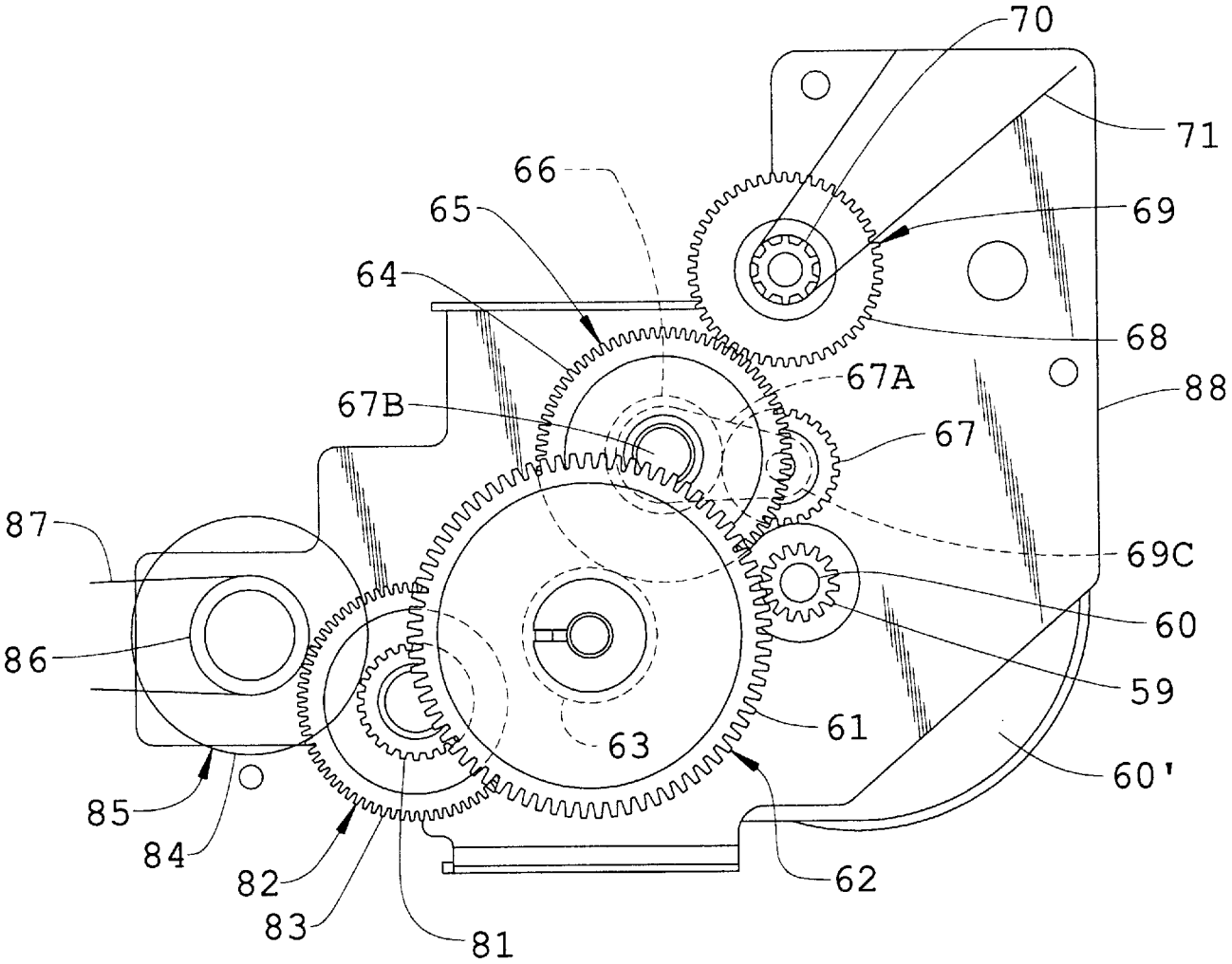
FIG. 7 is an elevation view of a drive system for the pick roll and the feed rolls of the sheet aligning apparatus of FIG. 1 in which the pick roll is not being driven and the feed rolls are being driven to feed the sheet.

When the pick roll 47 (see FIG. 1) is to be driven during a cycle of operation of the printer 11, the clutch gear 67 (see FIG. 6) is rotated counterclockwise to its position of FIG. 6 from its position of FIG. 7 (The position of the clutch gear 67 in FIG. 7 is its location at the end of a cycle of operation.). This occurs when the clutch gear 67 is rotated by the gear 66 of the compound gear 65. When the clutch gear 67 reaches its position of FIG. 6, it provides drive from the gear 66 of the compound gear 65 to a gear 68 of a compound gear-pulley 69.

A pulley 70 of the compound gear-pulley 69 engages a drive belt 71, which engages a pulley (not shown) on an end of the rotatable shaft 51 (see FIG. 1) exterior of the left side wall 16. The drive belt 71 (see FIG. 6) has teeth on its inner surface for engaging teeth on the pulley 70 and the pulley (not shown) on the end of the rotatable shaft 51 (see FIG. 1).

The rotatable shaft 51 has a gear (not shown) thereon for engaging a gear drive train 72 (see FIG. 4) to rotate a gear 73 for rotating the pick roll 47. Because of the distance that the clutch gear 67 (see FIG. 6) must move between the positions of FIG. 7 and FIG. 6, there is a slight delay from energization of the motor 60' until the pick roll 47 is rotated.

Figure 4:
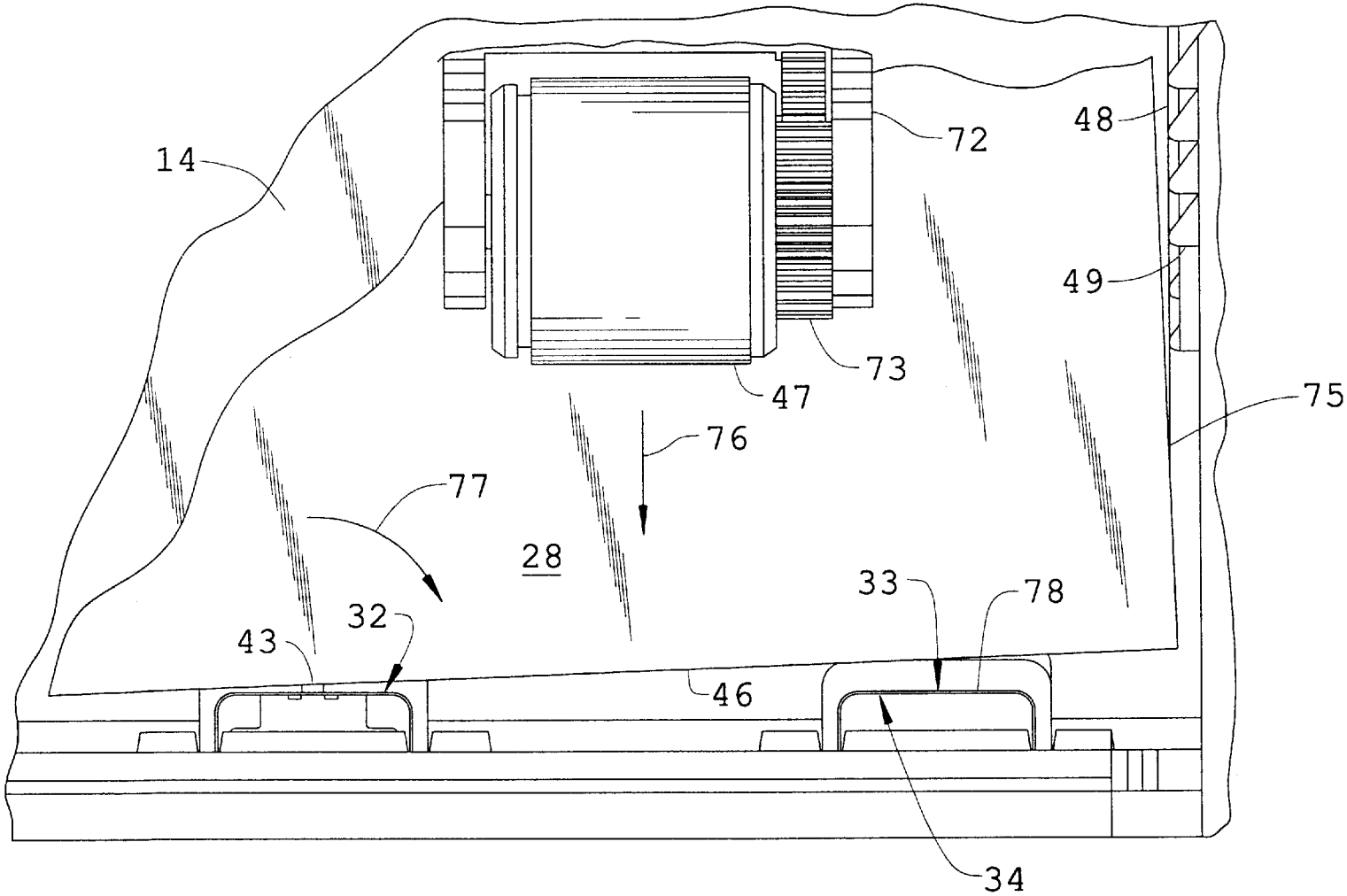
FIG. 4 is an enlarged fragmentary top plan view of a portion of the sheet aligning apparatus of FIG. 1 with a sheet having its leading edge skewed.

The sheet 28 (see FIG. 4) may be skewed when it is loaded as shown in FIG. 4. As a result, a side 75 of the sheet 28 will not be aligned with the alignment surface or edge 48. When the pick roll 47 is energized during a cycle of operation, it exerts a force on the uppermost sheet 28 in the direction of an arrow 76.

The projection 43 of the rib 32 extends beyond the ribs 33 so that the projection 43 is engaged prior to the rib 33 on its right being engaged when the sheet 28 is skewed. Therefore, the force exerted by the pick roll 47 in the direction of the arrow 76 produces a clockwise torque as indicated by an arrow 77. This torque causes the sheet 28 to be moved about the projection 43 as a pivot to cause the side 75 of the sheet 28 to move into engagement with the alignment surface 48 or edge. This occurs when the leading edge 46 of the sheet 28 abuts a surface 78 of the body 34 of each of the ribs 33.

As the side 75 of the uppermost sheet 28 is aligned with the alignment surface or edge 48 during the initial energization of the pick roll 47 during its cycle of operation, the leading edge 46 of the sheet 28 engages the coating 35 (see FIG. 3) on the body 34 of the rib 32 so that corrugation or buckling occurs at the rib 32. Once buckling occurs, a buckle is formed at the rib 32 in the manner described in the copending patent application of Stephen A. Oleska et al, U.S. Ser. No. 08/879,351, filed Jun. 20, 1997, which is incorporated by reference herein and is now U.S. Pat. No. 5,895,040.

When buckling of the fed sheet 28 occurs, a large portion of the load is taken on the coating 35 (see FIG. 3) with a horizontal force component. This net horizontal force component moves the fed sheet 28 along the rib 32 and the ribs 33.

As shown and described in the aforesaid Oleska et al application, the increased resistance force applied to the fed sheet 28 of the stack 29 (see FIG. 5) also is applied to other of the sheets 28 in the stack 29, particularly the sheet 28 next to the top sheet 28. This increase on the sheet 28 next to the fed sheet 28 holds the sheet 28 next to the fed sheet 28 while the fed sheet 28 is buckled so that the fed sheet 28 advances. This prevents double feeding.

This increase in resistance is proportional to the coefficient of friction of the high friction surface of the projection 43. Thus, it is desirable to have a very high coefficient of friction surface of the projection 43 to maximize the resistance force and minimize double feeds.

As shown in FIG. 5, the printer 11 has counter rotating feed rolls 79 and 80 towards which the leading edge 46 of the fed sheet 28 is advanced by the pick roll 47. Because of the pick roll 47 not being aligned with the axis or centerline of the sheet 28 but on one side thereof as shown in FIG. 4, the leading edge 46 of the sheet 28 on the non-driven side of the sheet 28 arrives at the counter rotating feed rolls 79 (see FIG. 5) and 80 prior to the leading edge 46 of the sheet 28 on the driven side of the sheet 28.

This is because the sheet 28 is constrained on its driven side by the pick roll 47 and not constrained on its non-driven side. This results in a shorter path for the sheet 28 on the non-driven side even though the sheet 28 is being fed relatively straight by the pick roll 47. However, because of the counter rotating feed rolls 79 and 80, the leading edge 46 of the sheet 28 will not be fed into the nip produced by the counter rotating feed rolls 79 and 80 until the directions of rotation of the feed rolls 79 and 80 are reversed.

When the pick roll 47 is energized to feed the sheet 28 at the start of a cycle of operation, the counter rotating roll 79 is rotated counterclockwise (as viewed in FIG. 5) by the gear 63 (see FIG. 6) of the compound gear 62 meshing with a gear 83 of a compound gear 82. A gear 81 of the compound gear 82 engages a gear 84 of a compound gear 85. The compound gear 85 has a gear 86 driving a drive belt 87, which drives the counter rotating roll 79 (see FIG. 5).

The motor 60' (see FIG. 6), the compound gears 62 and 65, the compound gear-pulley 69, and the compound gears 82 and 85 are supported by a substantially vertical support plate 88. The support plate 88 is supported on the left side wall 16 (see FIG. 1) of the frame 10 exterior thereof and spaced therefrom.

A sensor 89 (see FIG. 5) senses when the leading edge 46 of the sheet 28 arrives at a predetermined location with respect to the nip between the feed rolls 79 and 80. The pick roll 47 is stopped a predetermined distance after the sensor 89 senses the presence of the leading edge 46 of the sheet 28 through the motor 60' (see FIG. 6) being stopped prior to being reversed.

Of course, the leading edge 46 (see FIG. 5) of the sheet 28 on the non-driven side is not advanced through the nip until the directions of rotation of the feed rolls 79 and 80 are reversed. Therefore, the leading edge 46 again becomes parallel in the time between when the sensor 89 senses the presence of the leading edge 46 and driving of the pick roll 47 is stopped. Accordingly, the leading edge 46 of the sheet 28 is not skewed as it is advanced through the nip of the feed rolls 79 and 80.

After the pick roll 47 is stopped by stopping the motor 60' (see FIG. 7), the direction of rotation of the motor 60' is reversed to change the directions of rotation of the feed rolls 79 (see FIG. 5) and 80 to feed the sheet 28 to the process station. When the motor 60' (see FIG. 7) rotates in the reverse direction from FIG. 6, the clutch gear 67 is moved away from engagement with the gear 68 of the compound gear-pulley 69 because the gear 66 of the compound gear 65 rotates in the opposite direction to rotate the pivotally mounted arm 67A clockwise until it engages a stop pin (not shown) to stop the clutch gear 67 in the position of FIG. 7.

The pick roll 47 (see FIG. 1) has its surface closest to the rib support plate 30 spaced 36.7 mm from the upper surface 31 of the substantially horizontal bottom wall 12 of the frame 10, as measured by the distance between a line tangent to the pick roll 47 and parallel to the upper surface 31 of the substantially horizontal bottom wall 12 of the frame 10. The length of the insert 42 is 25 mm.

The pick roll 47 (see FIG. 1) has a diameter of 20 mm and a width of 15 mm. The axis of rotation of the pick roll 47 is 46 mm from the pivot axis of the pick roll arm 55, which is the same as the axis of the rotatable shaft 51. The pick roll 47 has its closest surface to the right side wall 15 at a distance of 31 mm therefrom. The front surface 27 of the inclined wall 14 is 23.1 mm from the pivot axis of the pick roll arm 55.

The centers of the three ribs 34 are located from the right side wall 15 at distances of 18.1, 133.1, and 186.6 mm. The center of the rib 32 is located from the right side wall 15 at a distance of 60.1 mm.

While the pick roll 47 has been described as part of an auto-compensating mechanism, it should be understood that such is not necessary. While the printer 11 has been described as an inkjet printer, it should be understood that the sheet aligning apparatus of the present invention may be utilized with other printers such as a laser printer, for example.

Additionally, it is not necessary that the feeding of the sheets 28 (see FIG. 5) be horizontal as it could be vertical. Likewise, the sheet aligning apparatus of the present invention may be utilized with a bottom fed system.

While the pick roll 47 has been utilized for both creating the torque and the advancement of the sheet 28, it should be understood that a second pick roll could be symmetrically aligned with respect to the axis or centerline of the sheet 28 for advancing the sheet after the pick roll 47 has been initially activated to create only the torque. The second pick roll would be energized only after the pick roll 47 is deenergized. Of course, this would increase the cost substantially.

An advantage of this invention is that it has a lower cost. Another advantage of this invention is that it enables sheets of a media to be loaded by a user with a greater amount of skew while still having each sheet aligned when it is supplied to a feed mechanism.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A sheet aligning apparatus for aligning an uppermost sheet of a stack of sheets of a media when the uppermost sheet is advanced from the stack so that its leading edge is substantially parallel to a predetermined position including:

support means for supporting a stack of sheets; side sheet engaging means for engaging one side of at least the uppermost sheet of the stack of sheets to align the one side of the uppermost sheet of the stack substantially perpendicular to the predetermined position;

an inclined base surface disposed in the path of movement of the uppermost sheet as it is advanced from the stack of sheets, said inclined base surface being inclined away from said support means at an obtuse angle to said support means;

said inclined base surface having sheet engaging means for engaging the leading edge of at least the uppermost sheet of the stack of sheets during its advancement from the stack of sheets;

a plurality of substantially parallel ribs extending from said inclined base surface having outer surfaces for initially engaging the leading edge of the advancing sheet;

only one of said substantially parallel ribs having a first surface of relatively high coefficient of friction and a second surface of relatively low coefficient of friction along which each sheet is advanced, each of said first and second surfaces being substantially parallel to said base surface and to each other, said second surface being proximate said first surface, and said first surface extending beyond said second surface for initial engagement by the leading edge of the advancing sheet;

at least one additional of said substantially parallel ribs having only said second surface, said one additional rib being disposed between said only one rib and said side sheet engaging means; and force applying means for applying a force to the uppermost sheet of the stack of sheets in a direction substantially parallel to said side sheet engaging means, said force applying means applying the force between said side sheet engaging means and said rib; and said force applying means applying the force to the uppermost sheet of the stack of sheets to produce a torque on the uppermost sheet through the leading edge of the uppermost sheet engaging said first surface of said sheet engaging means of said inclined element to cause the one side of at least the uppermost sheet of the stack of sheets to be aligned with said side sheet engaging means.

2. The apparatus according to claim 1 in which:

said force applying means is a pick roll for advancing the uppermost sheet from the stack of sheets towards the predetermined position in a direction substantially parallel to said side sheet engaging means;

and said pick roll applies the torque to the uppermost sheet of the stack of sheets in the initial portion of its activation during a cycle of operation.

3. The apparatus according to claim 2 in which said pick roll applies the only force for advancing the uppermost sheet from the stack of sheets towards the predetermined position in a direction substantially parallel to said side sheet engaging means.

4. The apparatus according to claim 3 in which:

at least two additional of said substantially parallel ribs have only said second surface and said only one rib is disposed between two of said substantially parallel ribs having only said second surface.

5. The apparatus according to claim 4 in which said first surface is movable relative to said second surface of said one substantially parallel rib when said first surface is engaged by the advancing sheet.

6. The apparatus according to claim 3 in which said first surface is movable relative to said second surface of said only one rib when said first surface is engaged by the advancing sheet.

7. The apparatus according to claim 2 in which:

at least two additional of said substantially parallel ribs have only said second surface and said only one rib is disposed between two of said substantially parallel ribs having only said second surface.

8. The apparatus according to claim 7 in which said first surface is movable relative to said second surface of said only one rib when said first surface is engaged by the advancing sheet.

9. The apparatus according to claim 2 in which said first surface is movable relative to said second surface of said only one rib when said first surface is engaged by the advancing sheet.

10. The apparatus according to claim 1 in which:

said force applying means applies the only force for advancing the uppermost sheet from the stack of sheets to the predetermined position in a direction substantially parallel to said side sheet engaging means;

and said force applying means applies the torque to the uppermost sheet of the stack of sheets in the initial portion of its activation during a cycle of operation.

11. The apparatus according to claim 10 in which:

at least two additional of said substantially parallel ribs have only said second surface and said only one rib is disposed between two of said substantially parallel ribs having only said second surface.

12. The apparatus according to claim 11 in which said first surface is movable relative to said second surface of said only one rib when said first surface is engaged by the advancing sheet.

13. The apparatus according to claim 1 in which said first surface is movable relative to said second surface of said only one rib when said first surface is engaged by the advancing sheet.

* * * * *

UNITED STATES PATENT AND TRADEMARK OFFICE

CERTIFICATE OF CORRECTION

PATENT NO : 5,971,390

DATED : October 26, 1999

INVENTOR(S) : Christopher Keith Caspar et al.

It is certified that error appears in the above-identified patent and that said Letters Patent is hereby corrected as shown below:

Claim 1, Col. 9, line 22 Between "said" and "rib;" insert -- one --.

Claim 1, Col. 9, line 27 Delete "sheet engaging means of said inclined element" and substitute therefor -- one rib --.

Signed and Sealed this

Twenty-eighth Day of March, 2000

*Attest:*

Q. TODD DICKINSON

*Attesting Officer*

*Commissioner of Patents and Trademarks*